United States Patent [19]

Takahashi et al.

[11] 4,371,292

[45] Feb. 1, 1983

[54] GRAVITY STRUCTURE

[75] Inventors: Munetoshi Takahashi; Takashi Kato, both of Tokyo, Japan

[73] Assignee: Kabushiki Kaisha Meiji Gomu Kasei, Tokyo, Japan

[21] Appl. No.: 159,629

[22] Filed: Jun. 16, 1980

[30] Foreign Application Priority Data

Jul. 2, 1979 [JP] Japan ..... 54-83827

[51] Int. Cl.[3] ..... E02D 5/74; E02B 3/06

[52] U.S. Cl. ..... 405/224; 405/21

[58] Field of Search ..... 405/15, 20–23, 405/25, 29, 207, 208, 210, 202, 224, 229; 52/169.9, 177, 596, 603, 403, 421, 167

[56] References Cited

U.S. PATENT DOCUMENTS

| | | | |
|---|---|---|---|
| 844,295 | 2/1907 | Winslow | 405/229 |
| 2,741,910 | 4/1956 | Thornley | 405/229 X |
| 2,895,301 | 7/1959 | Casagrande et al. | 405/208 |
| 3,738,113 | 6/1973 | Madary et al. | 405/210 |
| 3,913,291 | 10/1975 | Dulien et al. | 52/177 |
| 3,934,540 | 1/1976 | Bruner et al. | 405/21 |
| 3,998,062 | 12/1976 | Longe | 52/167 X |
| 4,014,177 | 3/1977 | Jarlan | 405/210 |
| 4,187,573 | 2/1980 | Fyfe et al. | 52/167 X |

*Primary Examiner*—David H. Corbin
*Assistant Examiner*—Nancy J. Pistel
*Attorney, Agent, or Firm*—Armstrong, Nikaido, Marmelstein & Kubovcik

[57] ABSTRACT

A gravity structure such as caisson, concrete block or L-shaped block that is used in the construction work of breakwaters, seawalls, and wharfs. The gravity structure of the invention is stable and hardly moved by external force such as wave force, and is characterized in that a plurality of unit friction members are disposed in the bottom surface of a concrete body, said unit fraction members increasing the coefficient of friction between the surface of foundation and said concrete body, and said unit friction members are so embedded integrally in said concrete body that the bottom surfaces of unit fraction members are brought into contact with the foundation surface.

2 Claims, 4 Drawing Figures

GRAVITY STRUCTURE

BACKGROUND OF THE INVENTION (1) Field of the Invention

This invention relates to a gravity structure.

More particularly, the invention relates to a gravity structure such as a caisson, concrete block and L-shaped block that are used for the construction work of breakwaters, river and sea walls and wharfs.

(2) Description of the Prior Art

It is necessary that these gravity structures are fixed at the points to be installed and they do not move. It is, however, difficult to install these gravity structures fixedly to foundation surfaces and they are liable to be moved by external forces. When breakwaters are constructed by using caissons, the seabed is excavated and levelled, and rubble is laid on the levelled surface to form a foundation mound. The caissons are then sunk onto this foundation mound and they are filled with rubble, gravel, sand and concrete, thereby constructing breakwaters. In another method of construction work, asphalt mats are laid over a foundation mound, caissons are sunk onto the asphalt mats and rubble is laid in the spaces among the caissons to a certain height in order to prevent the caissons from moving, and further, the caissons are filled with stone, sand and concrete.

The breakwaters thus constructed naturally receives wave pressure from the open sea. The resistance of caissons against the wave pressure from the open sea depends upon the caissons' own weights, the friction between the bottoms of caissons and the foundation mound, and the amount of rubble that is laid on the sides of caissons.

Since the breakwaters using caissons are constructed simply by placing the caissons on the foundation mound as described above, there has been a problem that the caissons are liable to move when they receive any external force such as wave pressure.

BRIEF SUMMARY OF THE INVENTION

It is, therefore, the primary object of the present invention to provide highly stable gravity structures which are not easily moved by the external force.

Another object of the present invention is to provide gravity structures in which friction members are integrally embedded in the bottom surfaces of concrete bodies so as to increase the coefficient of friction.

BRIEF DESCRIPTION OF THE DRAWINGS

These and other objects and features of the present invention will be clearly understood by the following description with reference to the accompanying drawings, in which.

DESCRIPTION OF PREFERRED EMBODIMENT

Referring now to the accompanying drawings, the embodiment of the present invention will be described in the following.

Figure 1:
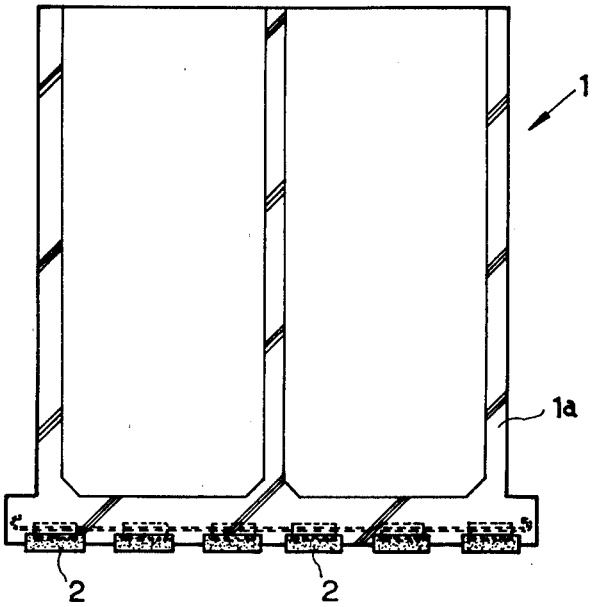
FIG. 1 is a vertical cross-sectional view of an embodiment of the gravity structure of the present invention.
Figure 2:
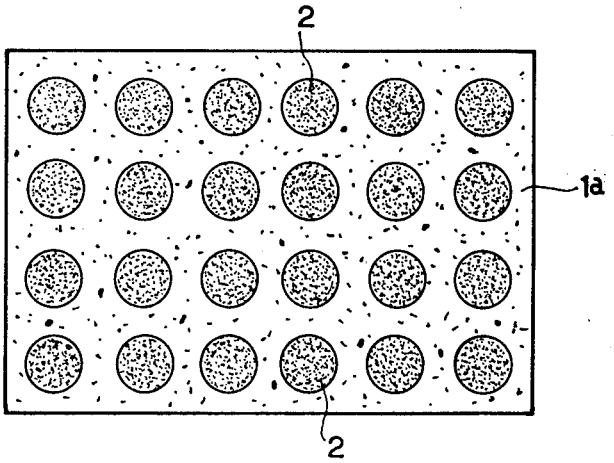
FIG. 2 is a bottom view of the same.

Shown in the drawing is an example of a caisson 1 which is used for the construction of breakwaters, sea walls and wharfs. The bottom surface of its conncrete body 1*a* is provided with a plurality of rubber-made unit friction members 2. This unit friction member 2 is in a shape of a flat column and is embedded in the concrete body 1*a* with exposing the under surface thereof so as to become in contact with the foundation surface. (See FIGS. 1 and 2.) The shape of this unit friction member 2 is not restricted to the columnar shape but it may be of square pillar or other shape. The distribution of the friction members 2 on the bottom surface is not restricted to the illustrated straight-lined distribution but it may be of zigzag or staggered distribution.

Figure 3:
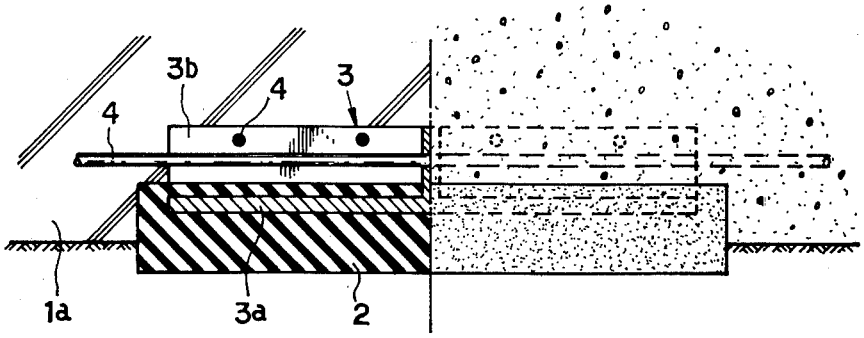
FIG. 3 is a front view partially in cross-section of the attached portion of a unit friction member.
Figure 4:
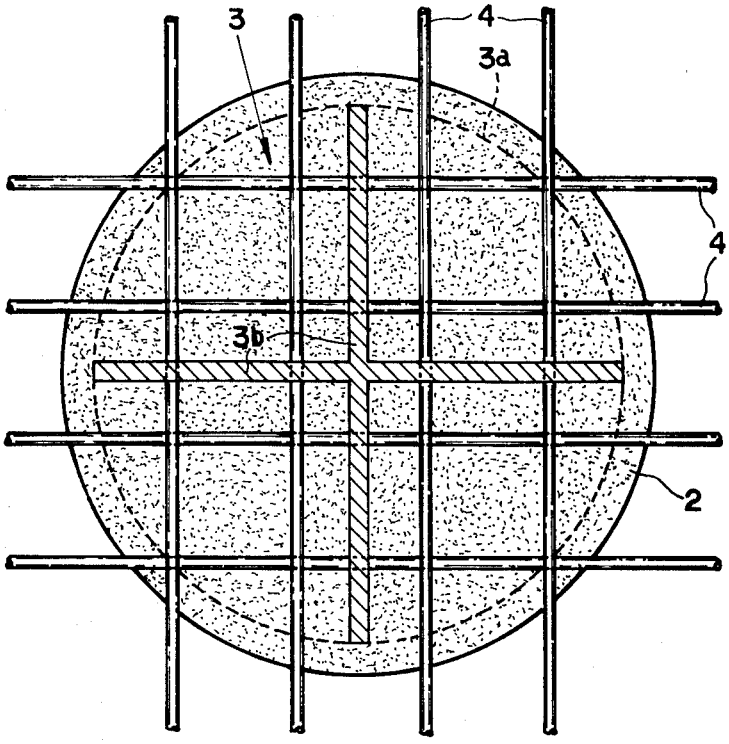
FIG. 4 is a plan view of the same before concrete placing.

As shown in FIGS. 3 and 4, the unit friction member 2 is integrally embedded in the concrete body 1*a* by means of a fixing member 3 and reinforcing bars 4.

The fixing member 3 is composed of a fixing plate 3*a* and ribs 3*b* which are disposed at a right angle to the fixing plate 3*a*. The fixing plate 3*a* is buried in the rubber block 2, thus the fixing member 3 and the rubber block 2 are integrally combined. Further, the rib 3*b* protrudes from the rear side of the rubber block and the reinforcing bars 4 that are laid in the concrete body 1*a* pass through the rib 3*b*. This rib 3*b* is of a cross-shaped configuration, therefore, the fixing member 3 can firmly be secured by the engagement with the crossed reinforcing bars 4. By the way, the fixing member 3 is embedded in the rubber block 2 when the latter is formed.

In the case that the rubber blocks 2 having such structure are attached to the concrete body 1*a*, a plurality of rubber blocks 2 that are previously provided with the fixing members 3, are disposed as desired and the reinforcing bars 4 are passed through the respective ribs 3*b* of the fixing members 3 and then concrete is placed thereon. When the concrete is cured, the rubber blocks 2 are integrally connected to the concrete body by means of the fixing members 3 and the reinforcing bars 4.

Since the caisson 1 has the structure as described above, the coefficient of friction between the surface of foundation and the rubber-made unit friction members 2 that are disposed in the bottom surface of the caisson 1 is increased. The coefficient of friction between concrete and concrete is 0.5 and the coefficient of friction between concrete and rubble-mound is 0.6, while the coefficient of friction of the caisson 1 of the present invention is more than 0.7, from which it will be understood that the caisson 1 of the present invention has an excellent resistance against external force.

As described above, since a plurality of unit friction members are integrally disposed in the bottom surface of the concrete body, the coefficient of friction between the caisson and the surface of foundation is much increased, therefore, quite stable gravity structure which does not move by external force can be obtained.

Further, in accordance with the present invention, the weight of the gravity structure can be reduced under the same use conditions, thus the gravity structure can advantageously be produced at lower cost.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A concrete body gravity structure for resting bottom downwards on a surface of a foundation under water including a concrete body having a bottom surface; a plurality of unit friction members each being composed of a rubber block having a flat bottom surface and each having at least one fixing member partially embedded therein, said unit friction members being embedded intgrally in the concrete body with a portion of each member protruding from the bottom surface thereof; and a plurality of reinforcing bars embedded in said concrete body passing through said fixing members; the bottom surface of said unit friction members being caused to contact with the surface of the foundation thereby increasing the co-efficient of friction between the surface of the foundation and the bottom surface of the concrete body underwater.

2. The gravity structure as claimed in claim 1 wherein the shape of each said unit friction member is a flat solid column.

* * * * *